United States Patent [19]

Stenstrom

[11] 4,163,559

[45] Aug. 7, 1979

[54] COMPARTMENTED CARD GAME BOX WITH REMOVABLE DRAWER

[76] Inventor: Sadie M. Stenstrom, 108 S. Mansfield St., Ironwood, Mich. 49938

[21] Appl. No.: 839,004

[22] Filed: Oct. 3, 1977

[51] Int. Cl.[2] ..... A63F 1/10

[52] U.S. Cl. ..... 273/148 A; 206/579

[58] Field of Search ..... 273/148 R, 148 A; 206/315 R, 579

[56] References Cited

U.S. PATENT DOCUMENTS

| | | | |
|---|---|---|---|
| D. 164,862 | 10/1951 | Johnson | 273/148 A X |
| 766,545 | 8/1904 | Sterl | 273/148 A |
| 2,130,762 | 9/1938 | Borden | 273/148 A |
| 3,580,582 | 5/1971 | Calamvotsakis | 273/139 |

*Primary Examiner*—Anton O. Oechsle

*Attorney, Agent, or Firm*—Howard I. Podell

[57] ABSTRACT

A novel card game with novel rules is disclosed as well as a utility package therefor. The package includes a bottom divided into separate compartments for a deck of cards, kitty and play money. The top of the package has indicia thereon to allow use thereof as a playing board for travel and serves also as a display sales package for the game and the game accessories.

1 Claim, 2 Drawing Figures

COMPARTMENTED CARD GAME BOX WITH REMOVABLE DRAWER

FIELD OF THE INVENTION:

This invention relates generally to an improved card game and apparatus for playing same.

STATEMENT OF PRIOR ART:

The prior art, as exemplified by U.S. Pat. Nos. 957,105; 912,547; 1,616,884, and 1,073,786 is generally illustrative of various games of this type. While such games are generally acceptable for their intended purpose they have not proven to be entirely satisfactory in that they are either complex and expensive to manufacture, or bulky and inconvenient to use, or require unusual skill and/or dexterity to operate.

The principal object of this invention is to provide a card game which combines interest and concentration together with inexpensiveness of construction.

Other objects of this invention will in part be obvious and in part hereinafter pointed out.

SUMMARY OF THE INVENTION

This invention resides in a novel card game is with novel rules is disclosed as well as a utility package therefor. This package includes a bottom divided into separate compartments for a deck of cards, kitty and play money. The top of the package has indicia thereon to allow use thereof as a playing board for travel and serves also as a display sales package for the game and the game accessories.

BRIEF DESCRIPTION OF THE DRAWINGS

In the accompanying drawing, in which is shown one of the various possible illustrative embodiments of this invention, wherein like reference character identify the same or like parts.

Figure 1:
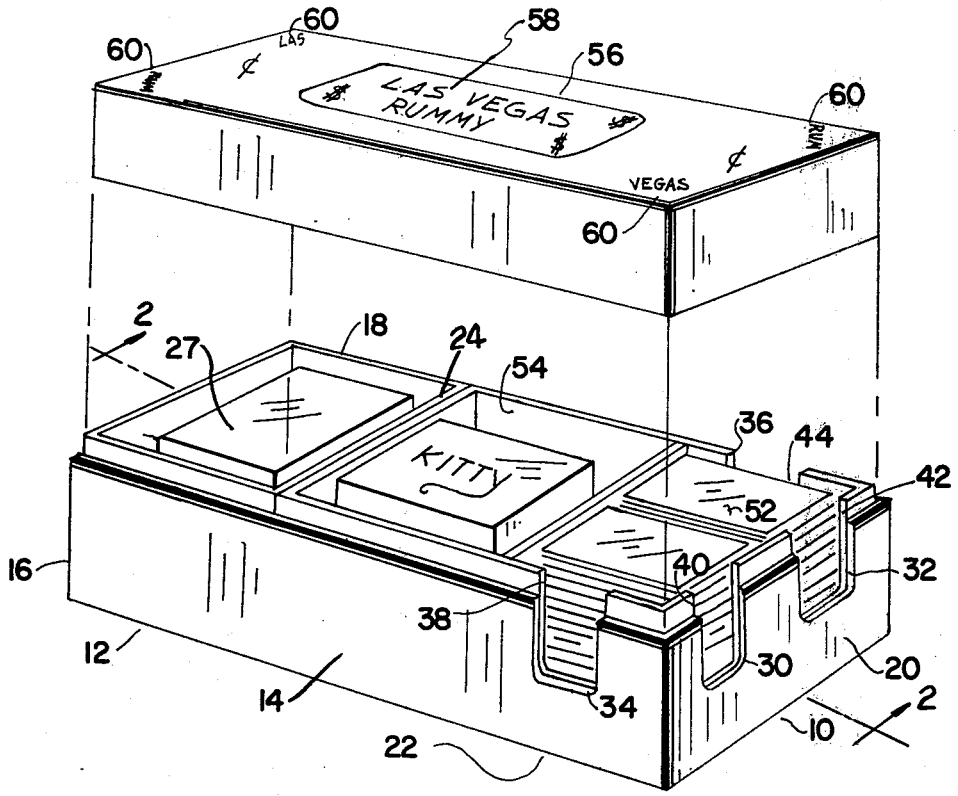
FIG. 1 is an exploded view of the game box kit according to the invention.

DESCRIPTION OF THE PREFERRED EMBODIMENT:

With reference to the drawing, there is shown and illustrated a game and box kit therefor constructed in accordance with the principles of the invention and designated generally by reference character 10.

Figure 2:
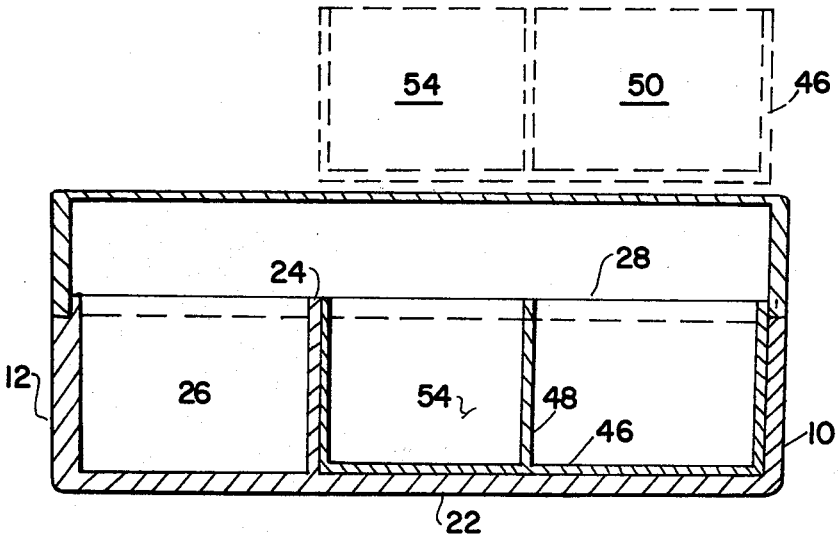
FIG. 2 is a sectional view of the box of FIG. 1, taken along lines 2—2 of FIG. 1, in the empty and closed box position, showing a compartment of the box kit pulled out by dash lines.

The game box kit comprises a bottom compartment 12 with side walls 14, 16, 18 and 20 integral with base 22. Bottom compartment is divided into 2 sections by partition 24. As shown in FIG. 2, section 26 for play money box 27 is about half of section 28.

Wall 20 has a pair of notched openings 30 and 32 while walls 14 and 18 have openings 34 and 36. These openings correspond in locations to openings 38, 40, 42 and 44 in the side walls of pull-out drawer 46. Drawer 46 includes a vertical partition 48, which divides it into a playing card compartment 50 for playing cards 52 and a "kitty" compartment 54 containing play money.

A top 56 fits on the box kit 12. Top 56 has thereon indicia giving the name of the game 58 and at each corner other indicia 60 descriptive of the game and marking the corner position which each serve as emplacement for cards dealt to the individual players.

During play, in particular when the game is being played on a plane or train, the cards may be laid on the center of top 56. The top also serves as display means for advertising the game in stores.

The game of the invention may be played by two or more players as follows:

For 2 Players—Deal 10 Cards
For 4 Players—Deal 8 Cards
For 6 Players—Deal 6 Cards Two decks of regular cards may be used for more than 6 players.

First deal cards same as regular Rum and card games, from left to right. After the first dealer is chosen, the person on his left then deals until all players deal. Then repeat through out game. All cards are held in hands till a player can lay down winning cards and discard one to determine him as winner of the hand. In order to win a hand, a player can have a combination of a straight run of 3 (or more) in any suit. Or a straight run of 3 or 4 in one suit and also another suit. Or a straight run and combination of 3 of a kind in any suit, or two runs of 4 of a kind along with a pair; or a run of 4 and 2 pairs. Runs and combinations must equal number of cards dealt according to number of players. Each player must place 52¢ worth of play money in kitty for winner of the first hand dealt. Then proceed to play hand and declare a winner.

For the rest of game, each player totals points left in his hand for next kitty as follows:

Aces=15 Points
2 through 9=That Number
10 through Kings=10 Points

If all cards are drawn and used during the playing of any hand dealt, the next player has option to draw or decline top card after deck is turned face down again. If declined, the dealer of that hand reshuffles and new card turned face up. Playing is then resumed until a winner is declared.

The operation and use of the invention hereinabove described will be evident to those skilled in the art to which it relates from a consideration of the foregoing.

It will thus be seen that there is provided a game in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A card game box kit comprising, in combination, a holder including a bottom part and a cover therefore, said cover serving as a game board and having a plurality of marked positions thereon to serve as emplacements for placing of cards that are dealt to a plurality of players and for laying down playing cards; a pair of compartments in said bottom part, said bottom part formed with a bottom wall joined to vertical side walls, with said compartments divided by a vertical partition and open to the top of the bottom part, a pull out drawer detachably resting in one of said compartments, said drawer formed of a bottom wall joined to vertical side walls, with said drawer divided by at least one partition to form a plurality of compartments to serve as storage space for playing cards, play money and other game accessories; with the vertical side walls of the drawer extending above the top of the bottom part so as to serve as support means for retaining the cover to the assembly of the bottom part and the drawer, in the closed position of the cover; in which said bottom part and said drawer have aligned vertical notches in a respective adjacent side wall of each, located so as to form a continuous opening, to provide access from the outside of the contents of a storage space of said drawer, in the assembled position of the drawer in the bottom part.

* * * * *